US006386827B2

(12) United States Patent
Yu et al.

(10) Patent No.: US 6,386,827 B2
(45) Date of Patent: May 14, 2002

(54) NOZZLE AIRFOIL HAVING MOVABLE NOZZLE RIBS

(75) Inventors: Yufeng Phillip Yu; Gary Michael Itzel, both of Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/898,470

(22) Filed: Jul. 5, 2001

Related U.S. Application Data

(63) Continuation of application No. 09/372,190, filed on Aug. 11, 1999, now abandoned.

(51) Int. Cl.[7] ..... F01D 9/04; F01D 25/26

(52) U.S. Cl. ..... 415/136; 415/115; 415/191; 416/233

(58) Field of Search ..... 415/115, 134, 415/135, 136, 191; 416/90 R, 92, 96 R, 96 A, 97 A, 232, 233

(56) References Cited

U.S. PATENT DOCUMENTS

| | | | | |
|---|---|---|---|---|
| 3,095,180 A | | 6/1963 | Clarke et al. | |
| 3,171,631 A | | 3/1965 | Aspinwall | |
| 3,369,792 A | | 2/1968 | Kraimer et al. | |
| 3,606,580 A | | 9/1971 | Kaufman, Sr. | |
| 3,619,077 A | | 11/1971 | Wile et al. | |
| 4,153,386 A | * | 5/1979 | Leogrande et al. | 415/115 |
| 5,203,873 A | | 4/1993 | Corsmeier et al. | |
| 5,342,172 A | | 8/1994 | Coudray et al. | |
| 5,358,379 A | | 10/1994 | Pepperman et al. | |
| 5,813,832 A | | 9/1998 | Rasch et al. | |

FOREIGN PATENT DOCUMENTS

| | | |
|---|---|---|
| GB | 1 323 883 | 7/1973 |
| GB | 2 106 996 | 4/1983 |
| JP | 58-214602 | 12/1983 |
| JP | 61-51124 | 11/1986 |

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

(List continued on next page.)

*Primary Examiner*—Christopher Verdier
(74) *Attorney, Agent, or Firm*—Nixon & Vanderhye PC

(57) ABSTRACT

A nozzle vane or airfoil structure is provided in which the nozzle ribs are connected to the side walls of the vane or airfoil in such a way that the ribs provide the requisite mechanical support between the concave side and convex side of the airfoil but are not locked in the radial direction of the assembly, longitudinally of the airfoil. The ribs may be bi-cast onto a preformed airfoil side wall structure or fastened to the airfoil by an interlocking slide connection and/or welding. By attaching the nozzle ribs to the nozzle airfoil metal in such a way that allows play longitudinally of the airfoil, the temperature difference induced radial thermal stresses at the nozzle airfoil/rib joint area are reduced while maintaining proper mechanical support of the nozzle side walls.

14 Claims, 3 Drawing Sheets

OTHER PUBLICATIONS

"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994—Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993—Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.

"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introdution/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Elecric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison E ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Tubine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.
"Proceedings of the Advanced Turbine Systems Annual Program Review Meeting", vol. I, "Pratt & Whitney Thermal Barrier Coatings", Bornstein et al., p. 182–193, Oct., 1995.
"Proceedings of the Advanced Turbine Systems Annual Program Review Meeting", vol. I, "Westinhouse Thermal Barrier Coatings", Goedjen et al., p. 194–199, Oct., 1995.

"Proceedings of the Advanced Turbine Systems Annual Program Review Meeting", vol. I, "High Performance Steam Development", Duffy et al., p. 200–220, Oct., 1995.
"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.
"Proceedings of the Advanced Turbine Systems Annual Program Review Meeting", vol. II, "Lean Premixed Flames for Low $No_x$ Combustors", Sojka et al., p. 249–275, Oct., 1995.
"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.
"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.
"Proceedings of the Advanced Turbine Systems Annual Program Review Meeting", vol. II, "Life Prediction of Advanced Materials for Gas Turbine Application", Zamrik et al., p. 310–327, Oct., 1995.
"Proceedings of the Advanced Turbine Systems Annual Program Review Meeting", vol. II, "Advanced Combustion Technologies for Gas Turbine Power Plants", Vandsburger et al., p. 328–352, Oct., 1995.
"Proceedings of the Advanced Turbine Systems Annual Program Review Meeting", vol. II, "Combustion Modeling in Advanced Gas Turbine Systems", Smoot et al., p. 353–370, Oct., 1995.
"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.
"Proceedings of the Advanced Turbine Systems Annual Program Review Meeting", vol. II, "Rotational Effects on Turbine Blade Cooling", Govatzidakia et al., p. 391–392, Oct., 1995.
"Proceedings of the Advanced Turbine Systems Annual Program Review Meeting", vol. II, "Manifold Methods for Methane Combustion", Yang et al., p. 393–409, Oct., 1995.
"Proceedings of the Advanced Turbine Systems Annual Program Review Meeting", Vol. II, "Advanced Multistage Turbine Blade Aerodynamics, Performance, Cooling, and Heat Transfer", Fleeter et al., p. 410–414, Oct., 1995.
"Proceedings of the Advanced Turbine Systems Annual Program Review Meeting, Vol. II", The Role of Reactant Unmixedness, Strain Rate, and Length Scale on Premixed Combustor Performance, Samuelsen et al., p. 415–422, Oct., 1995.
"Proceedings of the Advanced Turbine Systems Annual Program Review Meeting", vol. II, "Experimental and Computational Studies of Film Cooling With Compound Angle Injection", Goldstein et al., p. 423–451, Oct., 1995.
"Proceedings of the Advanced Turbine Systems Annual Program Review Meeting", vol. II, "Compatibility of Gas Turbine Materials with Steam Cooling", Desai et al., p. 452–464, Oct., 1995.
"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.
"Proceedings of the Advanced Turbine Systems Annual Program Review Meeting", vol. II, Effects of Geometry on Slot–Jet Film Cooling Performance, Hyams et al., p. 474–496 Oct., 1995.
"Proceedings of the Advanced Turbine Systems Annual Program Review Meeting", vol. II, "Steam as Turbine Blade Coolant: Experimental Data Generation", Wilmsen et al., p. 497–505, Oct., 1995.
"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.
"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.
"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.
"Proceedings of the Advanced Turbine Systems Annual Program Review Meeting", vol. II, "Bond Strength and Stress Measurements in Thermal Barrier Coatings", Gell et al., p. 539–549, Oct., 1995.
"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.
"Proceedings of the Advanced Turbine Systems Annual Program Review Meeting", vol. II, "Combustion Instability Modeling and Analysis", Santoro et al., p. 552–559, Oct., 1995.
"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.
"Proceedings of the Advanced Turbine Systems Annual Program Review Meeting", vol. II, "Heat Pipe Turbine Vane Cooling", Langston et al., p. 566–572, Oct., 1995.
"Proceedings of the Advanced Turbine Systems Annual Program Review Meeting", vol. II, "Improved Modeling Techniques for Turbomachinery Flow Fields", Lakshminarayana et al., p. 573–581, Oct., 1995.
"Proceedings of the Advanced Turbine Systems Annual Program Review Meeting", vol. II, "Advanced 3D Inverse Method for Designing Turbomachine Blades", T. Dang, p. 582, Oct., 1995.
"Proceedings of the Advanced Turbine Systems Annual Program Review Meeting", "ATS and the Industries of the Future", Denise Swink, p. 1, Nov., 1996.
"Proceedings of the Advanced Turbine Systems Annual Program Review Meeting", "Gas Turbine Association Agenda", William H. Day, p. 3–16, Nov., 1996.
"Proceedings of the Advanced Turbine Systems Annual Program Review Meeting", "Power Needs in the Chemical Industry", Keith Davidson, p. 17–26, Nov., 1996.
"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.
"Proceedings of the Advanced Turbine Systems Annual Program Review Meeting", "Overview of GE's H Gas Turbine Combined Cycle", Cook et al., p. 49–72, Nov., 1996.
"Proceedings of the Advanced Turbine Systems Annual Program Review Meeting", "Allison Advanced Simple Cycle Gas Turbine System", William D. Weisbrod, p. 73–94, Nov., 1996.
"Proceedings of the Advanced Turbine Systems Annual Program Review Meeting", "The AGTSR Industry–University Consortium", Lawrence P. Golan, p. 95–110, Nov., 1996.
"Proceedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.
"Proceedings of the Advanced Turbine Systems Annual Program Review Meeting", "Methodologies for Active Mixing and Combustion Control", Uri Vandsburger, p. 123–156, Nov., 1996.
"Proceedings of the Advanced Turbine Systems Annual Program Review Meeting", "Combustion Modeling in Advanced Gas Turbine Systems", Paul O. Hedman, p. 157–180, Nov., 19967.
"Proceedings of the Advanced Turbine Systems Annual Program Review Meeting", "Manifold Methods for Methane Combustion", Stephen B. Pope, p. 181–188, Nov., 1996.
"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.
"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.
"Proceedings of the Advanced Turbine Systems Annual Program Review Meeting", "Combustion Instability Studies Application to Land–Based Gas Turbine Combustors", Robert J. Santoro, p. 233–252.
"Proceedings of the Advanced Turbine Systems Annual Program Review Meeting", Active Control of Combustion Instabilities in Low $NO_x$ Turbines, Ben T. Zinn, p. 253–264, Nov., 1996.
"Proceedings of the Advanced Turbine Systems Annual Program Review Meeting", "Life Prediction of Advanced Materials for Gas Turbine Application," Sam Y. Zamrik, p. 265–274, Nov., 1996.
"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.
"Proceedings of the Advanced Turbine Systems Annual Program Review Meeting", "Compatibility of Gas Turbine Materials with Steam Cooling", Vimal Desai, p. 291–314, Nov., 1996.
"Proceedings of the Advanced Turbine Systems Annual Program Review Meeting", "Bond Strength and Stress Measurements in Thermal Barrier Coatings", Maurice Gell, p. 315–334, Nov., 1996.
"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.
"Proceedings of the Advanced Turbine Systems Annual Program Review Meeting", "Flow Characteristics of an Intercooler System for Power Generating Gas Turbines", Ajay K. Agrawal, p. 357–370, Nov., 1996.
"Prodeedings of the Advanced Turbine Systems Annual Program Review Meeting", "Improved Modeling Techniques for Turbomachinery Flow Fields", B. Lakshiminarayana, p. 371–392, Nov., 1996.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.
"Proceedings of the Advanced Turbine Systems Annual Program Review Meeting", "Advanced Turbine Cooling, Heat Transfer, and Aerodynamic Studies", Je–Chin Han, p. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.
"Proceedings of the Advanced Turbine Systems Annual Program Review Meeting", "Experimental and Computational Studies of Film Cooling with Compound Angle Injection", R. Goldstein, p. 447–460, Nov., 1996.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.
"Proceedings of the Advanced Turbine Systems Annual Program Review Meeting", "Steam as a Turbine Blade Coolant: External Side Heat Transfer", Abraham Engeda, p. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.
"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.

"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov., 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos.: DOE/MC/31176—5628.
"Utility Advanced Turbine System (ATS) Technology Readiness Testing—Phase 3", Document #666274, Oct., 1, 1996–Sep. 30, 1997, Publication Date, Dec. 31, 1997, Report Nos.: DOE/MC/31176—10.
"Utility Advanced Turbine System (ATS) Technology Readiness Testing and Pre–Commercial Demonstration, Phase 3", Document #486029, Oct. 1—Dec. 31, 1995, Publication Date, May 1, 1997, Report Nos.: DOE/MC/31176—5340.
"Utility Advanced Turbine System (ATS) Technology Readiness Testing and Pre–Commerical Demonstration—Phase 3", Document #486132, Apr. 1–Jun. 30, 1976, Publication Date, Dec. 31, 1996, Report Nos: DOE/MC/31176–5660.
"Utility Advanced Turbine System (ATS) Technology Readiness Testing and Pre–Commercial Demonstration—Phase 3", Document #587906, Jul. 1—Sep. 30, 1995, Publicaiton Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176–8.
"Utility Advanced Turbine System (ATS) Technology Readiness Testing and Pre–Commercialization Demonstration" Jan. 1—Mar. 31, 1996, DOE/MC/31176—5338.
"Utility Advanced Turbine System (ATS) Technology Readiness Testing: Phase 3R", Document #756552, Apr. 1—Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. 1—Mar. 31, 1998, Publication Date, Aug. 1, 1998, Report Nos.: DOE/MC/31176–17.
"Utility Advanced Turbine System (ATS) Technology Readiness Testing and Pre–Commercial Demonstration", Annual Technical Progress Report, Reporting Period: Jul. 1, 1995 –Sep. 30, 1996.
"Utility Advanced Turbine Systems (ATS) Technology Readiness Testing", Phase 3R, Annual Technical Progress Report, Reporting Period: Oct. 1, 1997—Sep. 30, 1998.
"Utility Advanced Turbine Systems (ATS) Technology Readiness Testing", Document #750405, Oct. 1—Dec. 30, 1998, Publication Date: May, 1, 1999, Report Nos. DE–FC21–95MC31176–20.
"Utility Advanced Turbine Systems (ATS) Technology Readiness Testing", Document #1348, Apr. 1—Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996—Sep. 30, 1997.
"Utility Advanced Turbine Systems (ATS) Technology Readiness Testing and Pre–Commercial Demonstration", Quarterly Report, Jan. 1—Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

NOZZLE AIRFOIL HAVING MOVABLE NOZZLE RIBS

This application is continuation of application Ser. No. 09/372,190, filed Aug. 11, 1999, now abandoned, the entire content of which is hereby incorporated by reference in this application.

This invention was made with Government support under Contract No. DE-FC21-95MC31176 awarded by the Department of Energy. The Government has certain rights in this invention.

BACKGROUND OF THE INVENTION

This invention relates to nozzle airfoil design, and more particularly, to an improved airfoil to airfoil rib joint for reducing thermal stresses at that junction.

Gas turbines typically include a compressor section, a combustor and a turbine section. The compressor section draws in ambient air and compresses it. Fuel is added to the compressed air in the combustor and the air fuel mixture is ignited. The resultant hot fluid enters the turbine section where energy is extracted by turbine blades, which are mounted to a rotatable shaft. The rotating shaft drives the compressor in the compressor section and drives, e.g., a generator for generating electricity or is used for other functions. The efficiency of energy transfer from the hot fluid to the turbine blades is improved by controlling the angle of the path of the gas onto the turbine blades using non-rotating, airfoil shaped vanes or nozzles. These airfoils direct the flow of hot gas or fluid from a nearly parallel flow to a generally circumferential flow onto the blades. Since the hot fluid is at very high temperature when it comes into contact with the airfoil, the airfoil is necessarily subject to high temperatures for long periods of time. Thus, in conventional gas turbines, the airfoils are generally internally cooled, for example by directing a coolant, which is compressed air in some systems and/or nozzle stages and steam in others, through internal cooling cavities in the airfoil.

Inside the airfoil, ribs are conventionally provided to extend between the convex and concave sides of the airfoil to provide mechanical support between the concave and convex sides of the airfoil. The ribs are needed to maintain the integrity the nozzle and reduce ballooning stress of the cavities. The ribs concurrently define at least part of the coolant flow path(s) through the airfoil. Thus, during engine operation, the internal ribs will be at a temperature level close to that of the coolant flowing through the airfoil, while the peripheral airfoil metal will generally be at a much higher temperature level. The mismatched temperatures result in high thermal stresses at the junctures of the ribs and the airfoil sidewalls. This high stress level combined with the high operating temperature results in fast deterioration of the vane at that area and thus deteriorated component life.

BRIEF SUMMARY OF THE INVENTION

The invention is embodied in a vane or nozzle airfoil structure in which one or more of the nozzle ribs are connected to the airfoil side walls in such a way that the ribs provide the requisite mechanical support between the concave side and convex side of the airfoil but are not locked in the radial direction of the vane or nozzle assembly, longitudinally of the vane or airfoil. This configuration minimizes the stress caused by the mismatch of the material temperature between the airfoil outer, side walls and the support ribs.

The mechanical support ribs may be bi-cast onto a preformed nozzle airfoil side wall structure or fastened to the airfoil by an interlocking slide connection and/or welding. This substantially independent formation and mechanical interconnection enables some play in the radial direction of the nozzle assembly, longitudinally of the airfoil. By attaching the nozzle ribs to the nozzle airfoil metal in such a way that allows play longitudinally of the airfoil, the temperature difference induced radial thermal stresses at the nozzle airfoil/rib joint area are reduced while maintaining proper mechanical support of the nozzle side walls.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
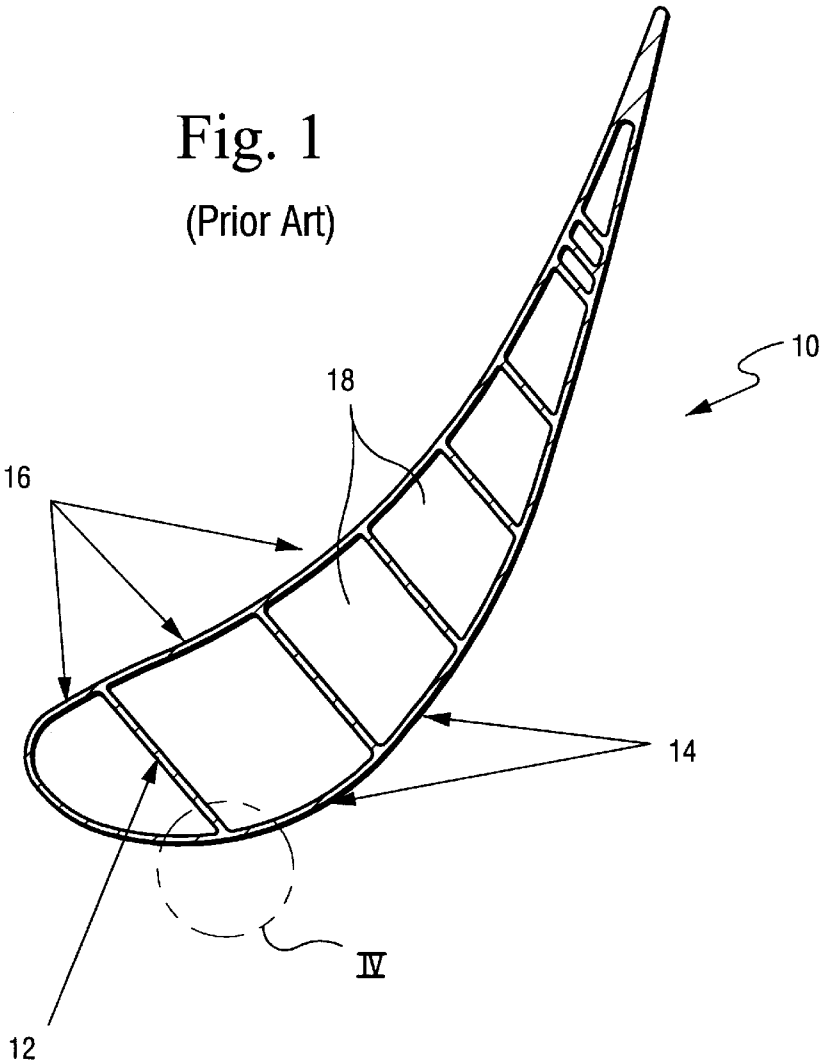
Fig. 1 (Prior Art)
FIG. 1 is a schematic cross-sectional view of an airfoil showing the internal rib or baffle connection between the airfoil convex side and the airfoil concave side.
Figure 2:
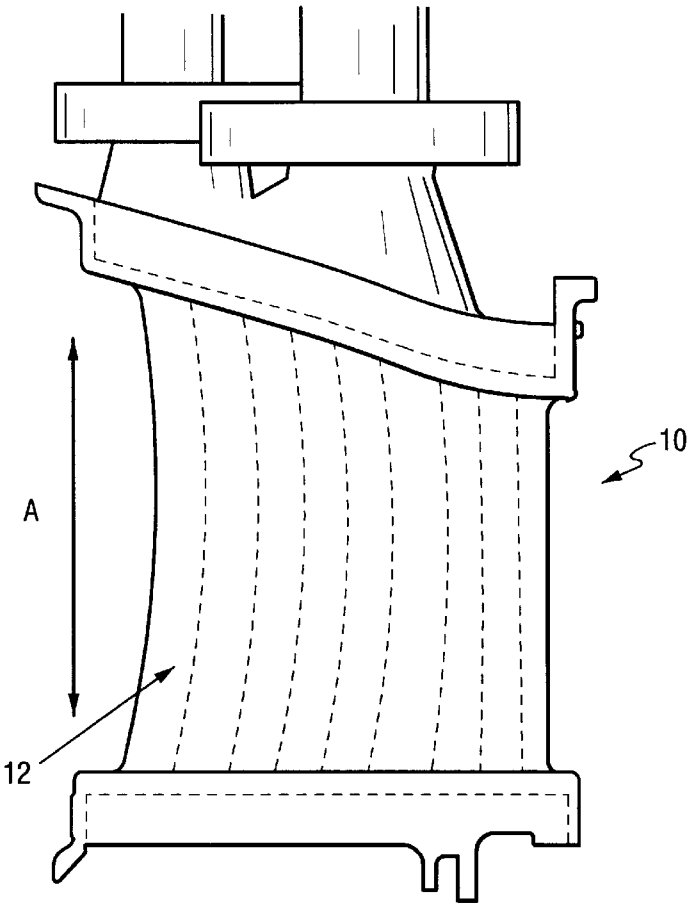
Fig. 2 (Prior Art)
FIG. 2 is a schematic elevational view of a nozzle airfoil.
Figure 3:
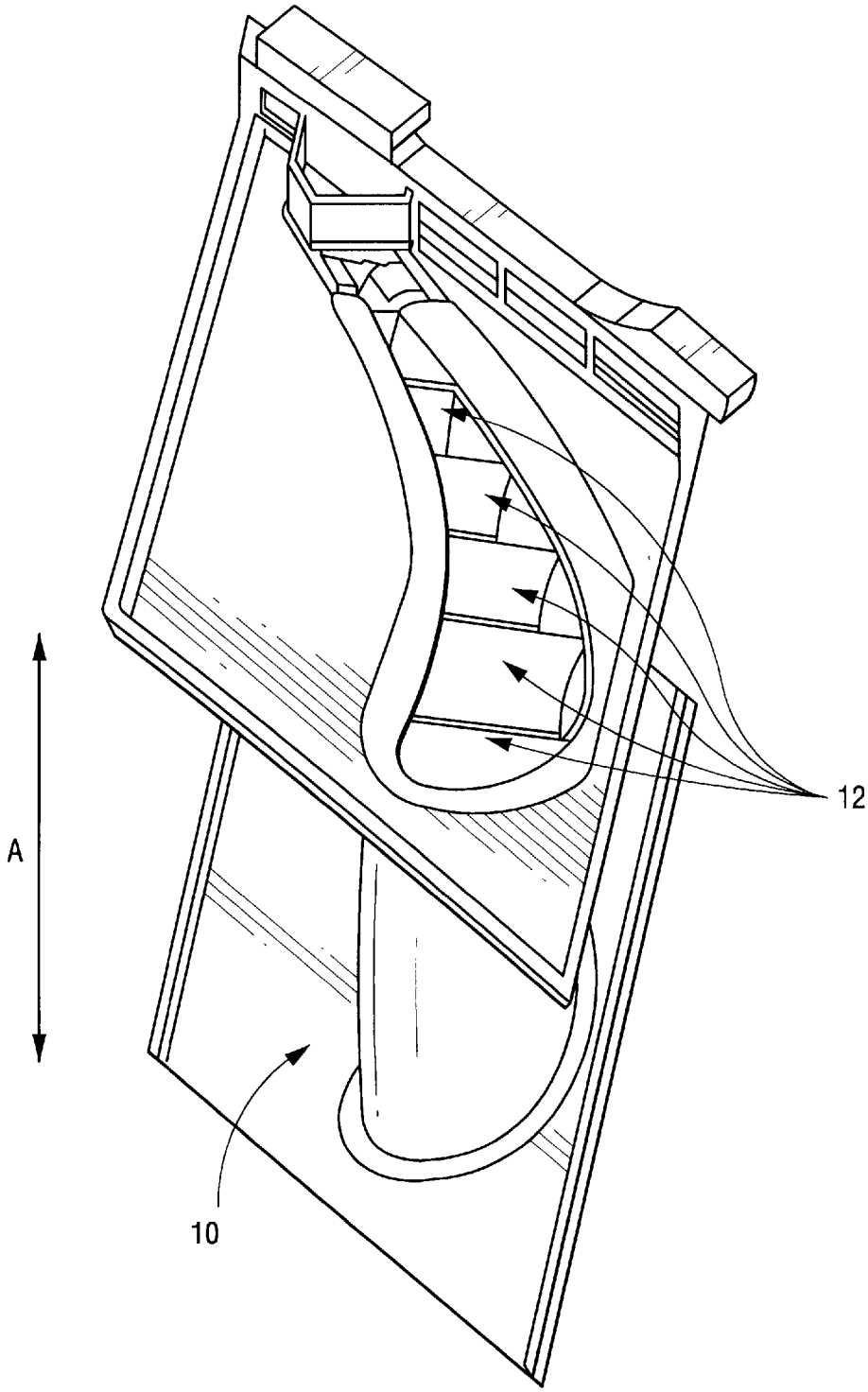
Fig. 3 (Prior Art)
FIG. 3 is a perspective view showing the typical disposition of ribs in a nozzle airfoil.
Figure 4:
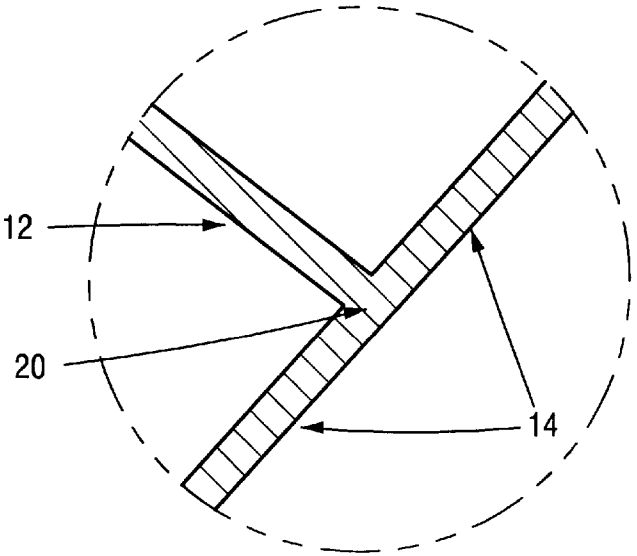
Fig. 4 (Prior Art)
FIG. 4 is a schematic view of detail IV in FIG. 1 showing a conventional airfoil to airfoil rib joint.

A conventional nozzle airfoil 10 having a series of ribs or baffles 12 extending between convex 14 and concave 16 sides thereof is shown by way of example in FIGS. 1–3. Typically, cooling air or steam enters one end of the airfoil and passes in a radial direction, longitudinally of the airfoil, along a serpentine path through the passages 18 defined between the respective mechanical support ribs or baffles 12. Conventionally, the airfoil walls 14, 16 and ribs or baffles 12 are cast as a single vane section or unit. Thus, as shown for example in FIG. 4, the airfoil walls and the airfoil ribs 12 are conventionally integrally formed in one piece from a common material.

As noted above, during engine operation, the ribs 12 are at a temperature level close to that of the coolant flowing through passages 18, whereas the airfoil walls 14, 16 are at a much higher temperature level. This mismatch in temperatures causes high thermal stress in the area of the joints 20 between the ribs 12 and the airfoil walls 14, 16. The high stress level combined with the high operating temperature reduces nozzle life at that area.

In accordance with an exemplary embodiment of the invention stress is reduced at the joints 120 of the nozzle ribs or baffle walls 112 and the nozzle side wall 114. More specifically, rather than integrally cast with the nozzle airfoil wall, the nozzle ribs 112 are connected to the nozzle airfoil wall 114 in such a way that the ribs 112 provide the requisite mechanical support between the convex 114 and concave (not shown) sides of the nozzle airfoil, and define at least a part of the coolant flow path(s) as in the conventional structure, but they are not locked in a radial direction of the nozzle section 114 (longitudinally of the respective airfoil). Such a connection, which is locked in a direction B transverse to the longitudinal extent of the airfoil, but which allows play longitudinally of the airfoil reduces the stresses caused by the temperature mismatch between the airfoil wall 114 and the ribs 112.

Figure 5:
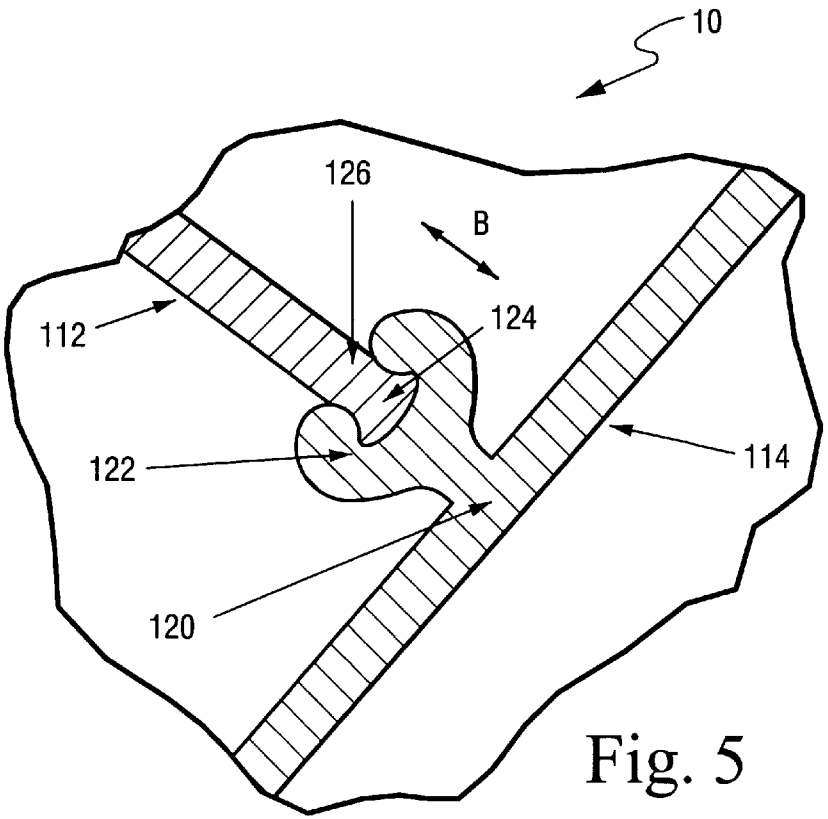
FIG. 5 is a schematic view of detail IV in FIG. 1 showing an airfoil to airfoil rib joint provided in accordance with an exemplary embodiment of the invention.

An exemplary coupling of the airfoil rib to the airfoil outer wall is schematically shown in FIG. 5. In the illustrated embodiment, a dovetail groove or receptacle 122 is defined on the interior of the airfoil outer (side) wall 114. A complimentary dovetail feature 124 is defined on the longitudinal side edge 126 of the rib 112 for locking engagement with the dovetail receptacle 122 of the airfoil wall 114, so as to substantially preclude relative movement of the rib 112 and the airfoil wall 114 in direction B, transverse to the longitudinal extent of the rib. However, relative movement between the rib 112 and the wall 114 is allowed, longitudinally of the joint 120. Thus, the nozzle ribs 112 are connected to the nozzle airfoil section in such a way that the ribs provide mechanical support between the concave and convex sides of the nozzle airfoil 110 but they are not locked in a radial direction.

To couple the ribs 112 to the airfoil side wall 114, the ribs 112 may be bi-cast on the nozzle airfoil wall 114. In this case, the airfoil is cast or machined with a sliding connection feature such as a dovetail receptacle, as shown, at the designated locations for rib attachment. A lower melting point alloy is then used to form the ribs, by casting onto the dovetail features of the airfoil. Because the ribs 112 and airfoil wall 114 are not integrally formed, the requisite play for reducing thermal stress at the joint 120 is possible.

As an alternative, the dovetail feature(s) 112 may be cast with or into the airfoil. Suitably cast or machined ribs may be then be slid into or onto the respective dovetail features to engage the complimentary connector structures of the ribs and airfoil walls respectively. The ribs may be welded to the airfoil outer wall e.g. at spaced locations along joint 120, if necessary or desirable to retain the ribs in position in the nozzle wall while still allowing for sufficient play to reduce thermal stresses.

While in the illustrated embodiment, the airfoil outer wall is illustrated as formed with a dovetail receptacle for receiving a suitable bulbous or dovetail portion on the rib, it is to be understood that the coupling configuration may be altered or reversed such that the dovetail or bulbous portion is defined on the airfoil outer wall and the receptacle therefor defined along the longitudinal side edges of the respective rib. Moreover, while in the illustrated embodiment the complementary coupling structures have been illustrated and described as dove-tail type configurations, it is to be understood that any of a variety of complementary coupling structures which allow for relative longitudinal sliding movement but limit or preclude play in a direction transverse thereto could be provided to interconnect the nozzle rib to the nozzle outer wall without departing from the invention disclosed herein.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A turbine vane, comprising:

an outer peripheral wall defining a hollow interior space and extending longitudinally in a first direction;

at least one internal baffle wall disposed in said hollow interior space, said at least one baffle wall extending longitudinally generally in said first direction, and being coupled to and extending in a second direction between opposing inner portions of said peripheral wall so as to provide mechanical support to said peripheral wall, said second direction being generally transverse to said first direction, said at least one baffle wall being structurally distinct from but mechanically coupled to said inner portions of said peripheral wall so as to be substantially transversely locked to said peripheral wall thereby to substantially prevent relative movement between said at least one baffle wall and said peripheral wall in said second direction, wherein said inner portions of said peripheral wall and longitudinal side edges of said baffle wall include complimentary interlocking coupling structures shaped to allow at least some relative longitudinal displacement, to thereby minimize thermal stresses in said first direction, and to substantially prevent relative movement in said second direction between said baffle wall and said peripheral wall and between said inner portions of said peripheral walls, to thereby provide mechanical support in said second direction.

2. A turbine vane as in claim 1, wherein said complimentary interlocking coupling structures comprise complimentary shaped projections and grooves.

3. A turbine vane as in claim 2, wherein a dovetail receptacle is defined one of on and in each said inner portion for receiving a complimentary dovetail bulbous portion of said baffle wall longitudinal side edge.

4. A turbine vane as in claim 1, wherein said baffle wall is formed independently from said peripheral wall and coupled to said inner portions thereof by slidably displacing the baffle wall relative to the peripheral wall to interconnect said complimentary coupling structures thereof.

5. A turbine vane as in claim 4, wherein said baffle wall is welded to said inner portions.

6. A turbine vane, comprising:

an outer peripheral wall defining a hollow interior space and extending longitudinally in a first direction;

at least one internal baffle wall disposed in said hollow interior space, said at least one baffle wall extending longitudinally generally in said first direction, and being coupled to and extending in a second direction between opposing inner portions of said peripheral wall so as to provide mechanical support to said peripheral wall, said second direction being generally transverse to said first direction, said at least one baffle wall being structurally distinct from but mechanically coupled to said inner portions of said peripheral wall so as to be substantially transversely locked to said peripheral wall thereby to substantially prevent relative movement between said at least one baffle wall and said peripheral wall in said second direction, wherein said inner portions of said peripheral wall define a coupling structure comprising at least one of a longitudinal groove and a longitudinal projection and said baffle wall is cast thereto so as to define a complementary coupling structure.

7. A turbine vane as in claim 6, wherein said baffle wall is formed from a material having a lesser melting point than a material of said peripheral wall.

8. A turbine airfoil, comprising:

an outer peripheral wall including a generally concave side wall and a generally convex side wall defining therebetween a hollow interior space;

a plurality of baffle walls extending between said convex side wall and said concave side wall so as to mechanically support said side walls and so as to divide said hollow interior space into a plurality of cooling passages for coolant flow; each said baffle wall extending longitudinally in a first direction generally parallel to a longitudinal axis of said outer peripheral wall, and extending between said side walls in a second direction generally transverse to said longitudinal axis of said outer wall, at least one of said baffle walls being structurally distinct from but mechanically coupled to said side walls so as to be substantially transversely locked to said convex and concave side walls to substantially prevent relative movement between said baffle wall and said convex and concave side walls in said second direction, wherein longitudinal side edges of said at least one baffle wall and said side walls include complimentary interlocking coupling structures to allow at least some relative longitudinal displacement in said first direction, to thereby minimize thermal stresses in said first direction, and to substantially prevent movement in said second direction between said baffle wall and each said side wall and between said side walls, to thereby provide mechanical support in said second direction.

9. A turbine airfoil as in claim 8, wherein said complimentary interlocking coupling structures comprise complementarily shaped projections and grooves.

10. A turbine airfoil as in claim 9, wherein a dovetail receptacle is defined one of on and in each said side wall for receiving a respective complimentary dovetail bulbous portion of a respective longitudinal side edge of said baffle wall.

11. A turbine airfoil as in claim 8, wherein said at least one baffle wall is formed independently from said side walls and coupled thereto by slidably displacing the baffle wall relative to the side walls to interconnect said complimentary coupling structures thereof.

12. A turbine airfoil as in claim 11, wherein said baffle wall is welded to said side walls.

13. A turbine airfoil, comprising:

an outer peripheral wall including a generally concave side wall and a generally convex side wall defining therebetween a hollow interior space;

a plurality of baffle walls extending between said convex side wall and said concave side wall so as to mechanically support said side walls and so as to divide said hollow interior space into a plurality of cooling passages for coolant flow; each said baffle wall extending longitudinally in a first direction generally parallel to a longitudinal axis of said outer peripheral wall, and extending between said side walls in a second direction generally transverse to said longitudinal axis of said outer wall, at least one of said baffle walls being structurally distinct from but mechanically coupled to said side walls so as to be substantially transversely locked to said convex and concave side walls to substantially prevent relative movement between said baffle wall and said convex and concave side walls in said second direction, wherein said side walls each include a coupling structure comprising at least one of a longitudinal groove and a longitudinal projection and said at least one baffle wall is cast thereto so as to define a complementary coupling structure.

14. A turbine airfoil as in claim 13, wherein said at least one baffle wall is formed from a material having a lesser melting point than a material of said side walls.

* * * * *